US005197723A

United States Patent [19]

Yamada et al.

[11] Patent Number: 5,197,723

[45] Date of Patent: Mar. 30, 1993

[54] AUTOMATIC DOCUMENT FEEDING APPARATUS

[75] Inventors: Yasushi Yamada; Yoshikazu Maekawa; Osamu Murata; Yoshio Ueda; Masanobu Kawano, all of Hachioji, Japan

[73] Assignee: Konica Corporation, Tokyo, Japan

[21] Appl. No.: 857,706

[22] Filed: Mar. 25, 1992

Related U.S. Application Data

[63] Continuation of Ser. No. 557,315, Jul. 23, 1990, abandoned.

[30] Foreign Application Priority Data

Jul. 29, 1989 [JP] Japan ..... 1-197622
Sep. 19, 1989 [JP] Japan ..... 1-244543

[51] Int. Cl.[5] ..... B65H 83/00

[52] U.S. Cl. ..... 271/3; 271/4; 271/6; 271/7; 271/902

[58] Field of Search ..... 271/3, 4, 6, 7, 10, 271/121, 122, 241, 258, 259, 265, 266, 270, 272, 171, 184–186, 902

[56] References Cited

U.S. PATENT DOCUMENTS 4,627,709 12/1986 Kitajima et al. ..... 271/3 X
4,817,933 4/1989 Honjo et al. ..... 271/184 X
4,875,072 10/1991 Ohnishi et al. ..... 355/23

FOREIGN PATENT DOCUMENTS 333107 9/1989 European Pat. Off. .
3821090 1/1989 Fed. Rep. of Germany .
3921252 1/1990 Fed. Rep. of Germany .
28143 3/1981 Japan ..... 271/6
92144 4/1989 Japan ..... 271/3
226642 9/1989 Japan ..... 271/7

OTHER PUBLICATIONS

IBM Technical Disclosure Bulletin vol. 25, No. 1; Jun. 1982.

Patent Abstracts of Japan, vol. 9, No. 148(P-366)(1871); Jun. 22, 1985; JPA-60-26332; Feb. 9, 1985.

*Primary Examiner*—David H. Bollinger
*Attorney, Agent, or Firm*—Jordan B. Bierman

[57] ABSTRACT

An automatic document feeding apparatus in which a plurality of documents are sequentially fed to an image exposure section. Before the completion of the exposure of a foregoing document, the feeding of a following document is started to place the document on a given position before the image exposure section and stopped thereon temporarily for stand-by. The position of the temporary stop of the following document can be varied in accordance with document size detecting signals from a document size detector or selected in such a manner that the distance between the trailing end of the foregoing document and the leading end of the following document becomes constant substantially irrespective of the size of the document.

12 Claims, 15 Drawing Sheets

FIG. 7

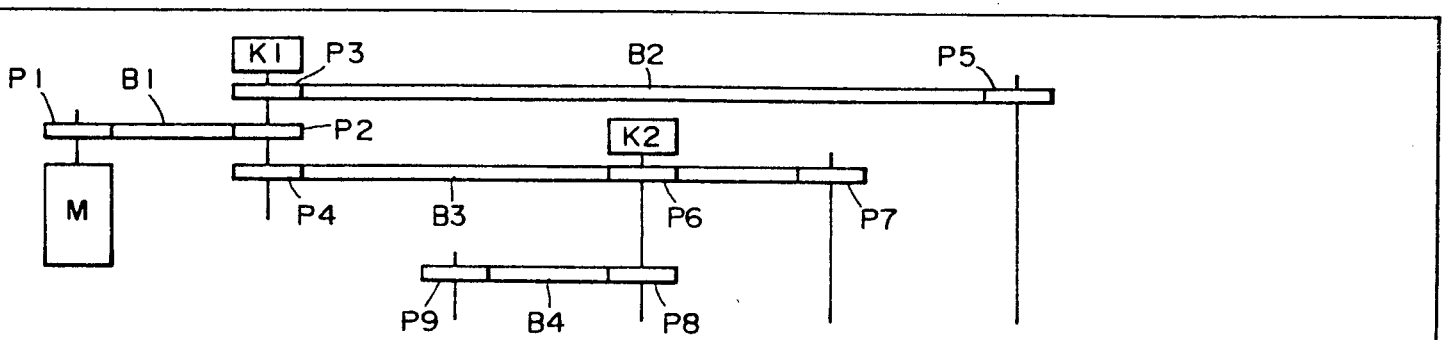

| PAPER FEED ROLLER DRIVING SYSTEM | | PERIPHERAL SPEED OF PICK-UP ROLLER (2) | PERIPHERAL SPEED OF FEED ROLLER SHAFT (22) | PERIPHERAL SPEED OF INTERMEDIATE ROLLER SHAFT (23) | PERIPHERAL SPEED OF BELT DRIVING ROLLER (9) | ELECTRO-MAGNETIC CLUTCH K1 | ELECTRO-MAGNETIC CLUTCH K2 |
|---|---|---|---|---|---|---|---|
| PAPER FEED ROLLER SHAFT PARTS | | | | | | | |
| AT DOCUMENT FEED (FROM START TO STOP) | | V1' | V1' | V1 | V1 | ON | ON |
| AT SCANNING EXPOSURE (DOCUMENT STOP) | | V2' | V2' | V2 | 0 | OFF | ON |
| FOREGOING DOCUMENT DISCHARGE FOLLOWING DOCUMENT FEED | | V1' | V1' | V1 | V1 | ON | ON |

AUTOMATIC DOCUMENT FEEDING APPARATUS

This application is a continuation of application Ser. No. 557,315, filed Jul. 23, 1990, now abandoned.

BACKGROUND OF THE INVENTION

1. Field of the Invention

The present invention relates to improvement of an automatic document feeding apparatus mounted on a recording apparatus of an electrophotographic reproducing machine and others.

2. Description of the Prior Art

The automatic document feeding apparatus is generally mounted for use on a document glass plate (platen glass). In a reproducing machine using a movable optical system on which this automatic document feeding apparatus is mounted, documents in sheets (hereinafter referred to simply as documents) of standard sizes (for example, JIS Standard A series, B series, or USA Standard sizes) are stacked on a document stacker (stacking section), and each sheet of the documents is fed out one by one from the stack by feed rollers and others of the automatic document feeding apparatus and is carried by a carrier belt onto the document glass plate where exposures of a given number of copies are conducted with an exposure lamp equipped in the body of the reproducing machine. Then, each of the documents is delivered onto a document delivery tray.

Conventionally, in such an automatic document feeding apparatus, the operation of replacing documents on the document glass plate is possible only for the documents having standard sizes such as series A, B, and others. Accordingly, the control can be applicable only to the documents of these standards. Also, the next document is fed out from the stack after a delivery sensor has detected the delivery of the preceding document from the document glass plate. Then, this next document is carried to the document glass plate and placed at a given position thereon. Thus, it takes a long time to complete replacing the document. Hence, the productivity of copying is lowered because a considerably long time is necessary for performing copying operation, and further it is impossible to reproduce documents of non-standard sizes.

However, in a case where documents are automatically fed and delivered onto the document glass plate for replacement using an automatic document feeding apparatus, the productivity of copying documents becomes 100% and no wasteful time is consumed, if the replacement of the documents is performed during the period in which the scanning optical system is returned to its home position.

In order to materialize this, it is necessary to carry the document at a high speed from the position for prevention of double-feed in the stacking section to the position where the document is stopped on the document glass plate.

However, carrying a document at a high speed causes various problems to arise, such as the necessity of using a larger driving motor, the increase in power consumption, the higher possibility of damages on documents, the lower performance of document separation. There is some apparatus in which when a document is automatically fed and delivered onto the document glass plate for replacement by the automatic document feeding apparatus, the feeding is performed during the period of exposure or during the period in which the scanning optical system returns to its home position to eliminate wasteful consumption of time. However, anyone of the automatic document feeding apparatuses is structured and controlled to handle only the documents of standard sizes. Hence, there is a problem that documents of sizes other than the standard ones (hereinafter referred to as non-standard standard sizes) cannot be handled by the automatic document feeding apparatuses.

SUMMARY OF THE INVENTION

The purposes of the present invention is to solve the problems set forth above, and to increase the number of copies per unit time.

An automatic document feeding apparatus according to the present invention which achieves the purpose mentioned above is the one in which a plurality of documents in sheets are sequentially fed to an image exposure section, and said document is stopped at said image exposure section for a scanning exposure by moving an optical system, then said document is delivered to a document delivery tray after the completion of the exposure, characterized in that before the completion of the exposure of a foregoing document in sheet, the feeding of the following document in sheet is started to place the document on a given position before said image exposure section and stopped thereon temporarily for stand-by, and that in accordance with document size detecting signals from a detecting means for detecting the size of said document, the position of the temporary stop of said following document is varied.

Further, the automatic document feeding apparatus according to the present invention is characterized in that at least two positions for temporary stop of the following document t › be set in accordance with the size are arranged, and one of the two positions of the temporary stop is selected in such a manner that the distance between the trailing end of the foregoing document and the leading edge of the following document temporarily stopped in the feeding passage becomes constant substantially irrespective of the size of the document.

Furthermore, the automatic document feeding apparatus according to the present invention is characterized in that the feeding speed for feeding a document to said position of the temporary stop is lower than the speed of carrying a document in the image exposure section.

Further, an automatic document feeding apparatus according to the present invention which achieves the purposes mentioned above is the one in which each sheet of the documents is separated by a separating means from stacked documents placed on a document stacker, and is fed and carried to an image exposure section; said document is stopped in said image exposure section, a scanning exposure is performed by a moving optical system; said document is ejected outside the apparatus by an ejecting means after the completion of the exposure; before the completion of exposure for said document the feeding of a following document is started to place the following document on a given position before said image exposure section and stopped temporarily for stand-by, characterized in that a detecting means is disposed on the downstream side of said separating means in the feeding direction for detecting the tip and trailing ends of a passing document; a document size detecting signal according to the passing of the foregoing document is generated by said detecting means before the feeding of the following document; the difference of the length of the document is detected by a controlling unit by comparing the length with a predetermined size of document; and if it is judged that an abnormal condition will occur in said temporary stopping mode, the feeding control for the temporary stop of the document is altered.

The automatic document feeding apparatus according to the present invention is characterized in that if an occurrence of abnormal condition is detected, the feeding of documents thereafter is conducted in a feeding mode without any temporary stop of document for stand-by.

Other objects and features of the present invention will become obvious from the following description taken in conjunction with the accompanying drawings.

BRIEF DESCRIPTION OF THE DRAWINGS

FIG. 7 is a table showing rotational speeds of feed rollers driven by the driving system;

DETAILED DESCRIPTION OF PREFERRED EMBODIMENTS

Figure 1:
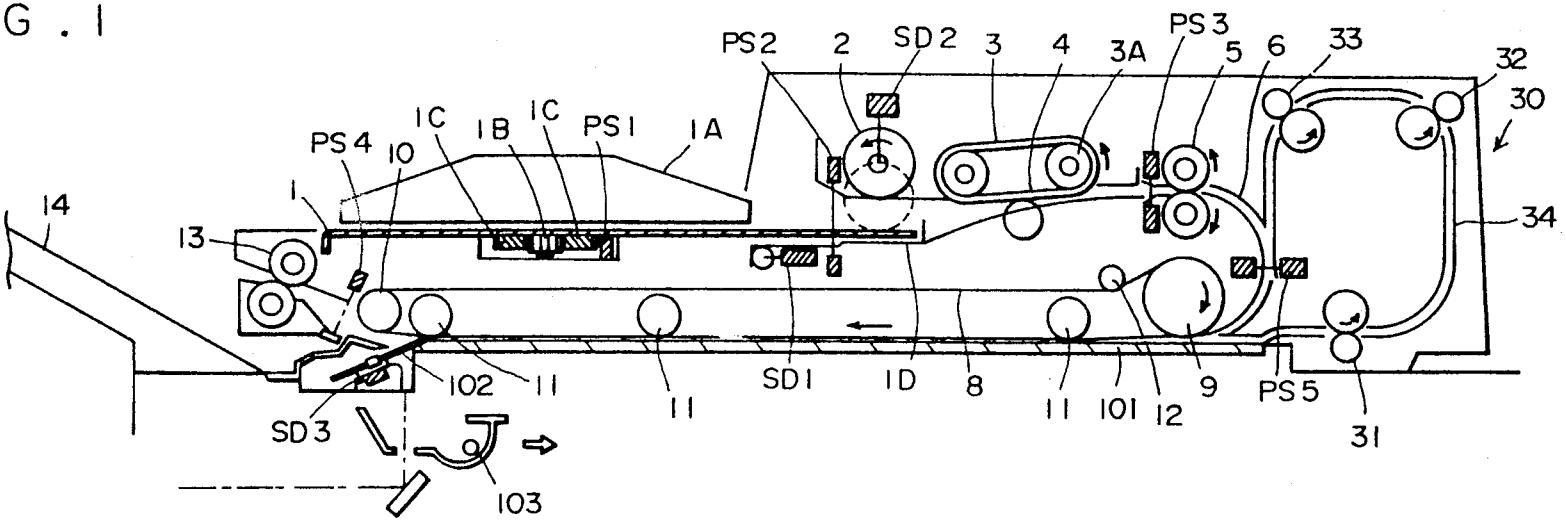
FIG. 1 is a view showing the structure of an automatic document feeding apparatus according to the present invention.

With reference to the drawings, an embodiment according to the present invention will subsequently be described in detail.

The apparatus shown in the drawings is an automatic document feeding apparatus (RADF) with automatic document reversing function.

Figure 5:
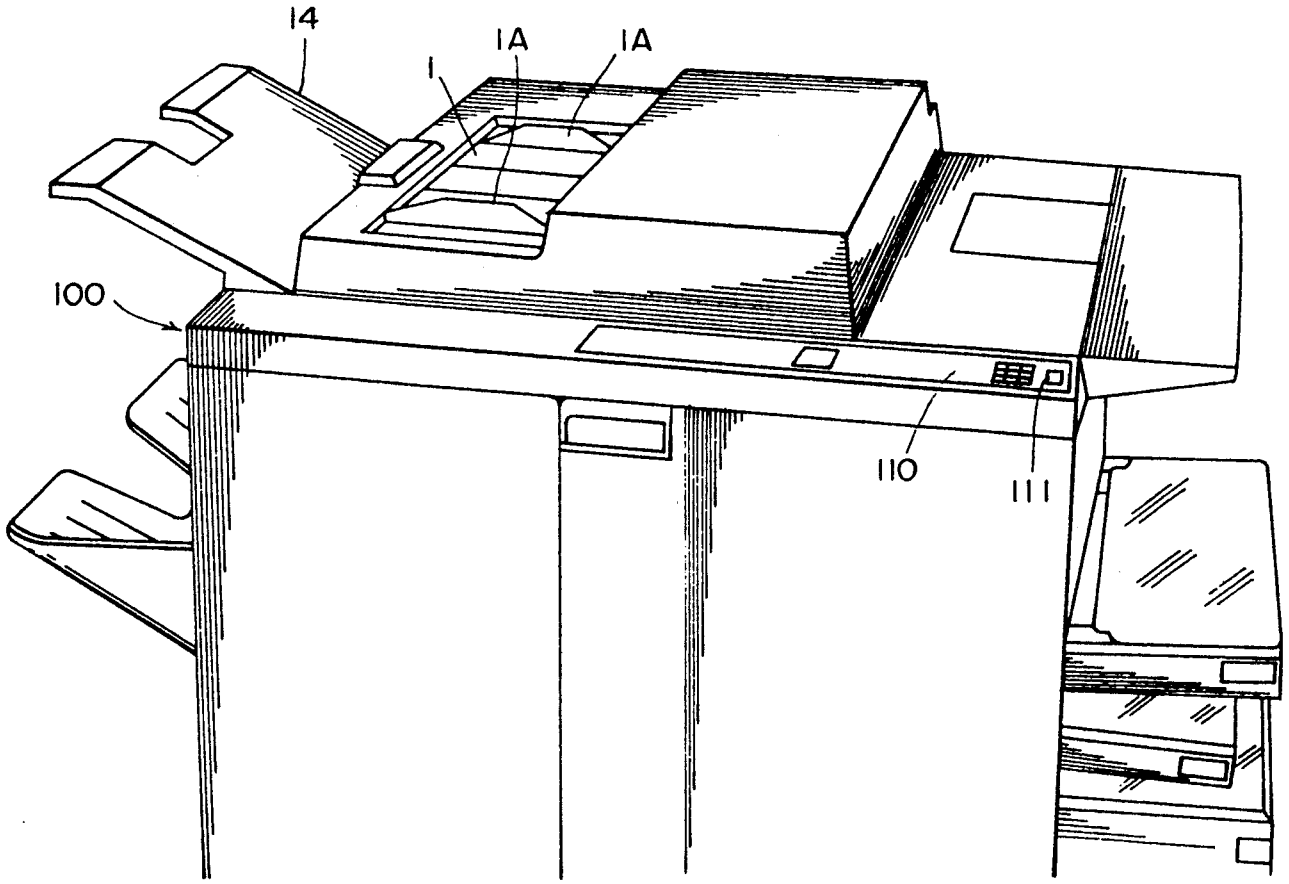
FIG. 5 is a perspective view showing the appearance of the upper portion of a reproducing machine on which the automatic document feeding apparatus is mounted.

First, with reference to FIGS. 1, 5, and 6(A), the structure and operation of the automatic document apparatus will be described.

On the left side of the upper face of the automatic document feeding apparatus, a document stacker 1 is disposed to stack documents. Provided beneath the front end of said stacker 1 are a document setting solenoid SD1 and a document edge stopper 1D swingable by said solenoid SD1. The upper end of said edge stopper 1D is projected in the vicinity of the end portion of the document stacker 1, and a stack of documents is placed on the stacker 1 in such a manner that the edge of the stack abuts against said document stopper 1D so as to be set in order.

When the stack of documents is placed on the stacker 1, the presence of the documents thereon is detected by a document setting detection sensor PS2(or sensor for detecting absence of document), and "ADF mode" is indicated on a control panel 110 on a reproducing machine 100.

On said document stacker 1, two breadth regulating boards 1A and 1A are provided to regulate the documents in the lateral direction. Under the document stacker 1, each of the breadth regulating boards 1A is respectively linked with each of racks 1C and 1C which are slidable in the lateral direction relatively, with a pinion 1B sandwitched therebetween. The racks 1C and 1C are connected respectively to the breadth regulating boards 1A and 1A, and the amount of their movement is detected by a document size detecting sensor PS1 so as to read the width of the document. Since the width and length of document of a standard size are naturally fixed (for example, the A4 size is 257 mm wide and 364 mm long), the length of the document is uniquely detetermined when the width thereof is detected. Therefore, a CPU can automatically find the length of the document D of a standard size in accordance with the measured value of the width. Hence, by sliding the breadth regulating boards 1A and 1A to come into contact with the stack of documents placed on the document stacker 1, the width of the document of any standard size is detected, and the length is calculated simultaneously by the CPU in accordance with the standardized size, and stored in the memory in order to conduct the control set forth below.

A pick-up roller 2 arranged above and in the vicinity of the end portion of said document stacker 1 is vertically movable by the operation of a feeding solenoid SD2 and the force by a spring, and is also rotatable by the driving force of a driving motor M. The automatic document feeding apparatus is started by operating a copying button 111 provided on said control panel 110. Then, said document feeding solenoid SD2 is actuated to lower the pick-up roller 2 to press the uppermost surface of the stack of documents. The pick-up roller is started to rotate simultaneously by the driving force of the driving motor M for the document feeding.

On the side of downstream of document feeding of the pick-up roller 2, there is provided a means for separating and feeding documents which comprises a feed belt 3 moving around a feed roller 3A, and a double-feed preventive roller 4 located underneath the feed belt 3. Said separating and feeding means separates and feeds only one document of the top of the documents fed out by the pick-up roller 2 which is rotated by the driving force transmitted from the driving motor M through an electromagnetic clutch K2.

On the downstream side of document feeding of said separating and feeding means, there are arranged a document pass detecting sensor PS3, a pair of intermediate carrying rollers 5, and curved guide plates 6.

The passing of the leading edge of a sheet of document fed out by the separating and feeding means is detected by the document pass detecting sensor PS3, and the sheet of document is subsequently fed by the pair of intermediate carrying rollers 5 arranged in the vicinity thereof through the guide plates 6. When the leading edge of the sheet of document passes a document synchronization sensor PS5 disposed in the middle of this passage, a detection signal is generated in order to control the document feeding. Said document synchronization sensor PS5 controls through clock timers the operations of a document stopper 102 described later, the driving motor M, a feed clutch K2, a carry clutch K1, and others.

Subsequently, the sheet of document is fed under a pressure between a carrying belt 8 and a document glass plate for document image exposure 101 (hereinafter referred to as a document glass plate) mounted on the upper face of the body of reproducing machine 100, and is stopped by the operation of a document stopper solenoid (latch type) SD3 at a position where the leading edge of the document abuts against the document stopper 102 which is projected from the left end of the upper face of the document glass plate 101.

The carrying belt 8 mentioned above is trained around a carrying belt driving roller 9, a driven roller 10, three document holding rollers 11, and a tension roller 12.

The document is exposed by an exposure lamp 103 in the body of reproducing machine at the stop position on the document glass plate 101. Then, the document image is formed on a recording member by scanning of an optical system comprising lenses, mirrors, and others.

Then, the same exposure process is repeated up to a given number of copies. When a series of copying operations for the document is completed, the projected portion of said document stopper 102 is withdrawn from the upper face of the document glass plate 101 to release the leading edge of the document. The document is delivered by the carrying belt 8 which are again started to rotate, and by a pair of delivery rollers 13, and after the passing of the trailing end of the document is detected by a document delivery detecting sensor PS4, the document is placed on a delivery tray 14 (stacker for delivered documents).

Furthermore, in this automatic document feeding apparatus, there is provided a document reversing section 30 where a document is reversed through a document reverse passage. Said document reversing section 30 comprises carrying rollers 31, 32, and 33, a guide plate 34, and the document synchronization sensor PS5 for detecting the document passing through said reversing section 30. This synchronization sensor PS5 is also used as a sensor for detecting the pass of a reversed document.

Figure 2:
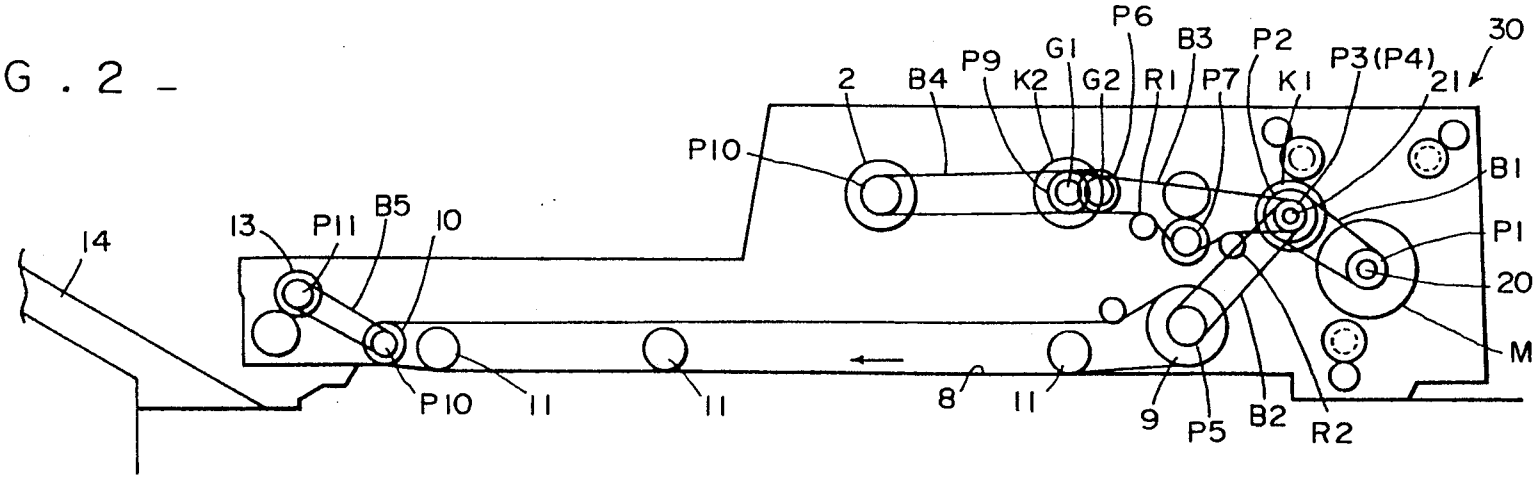
FIG. 2 is a view showing the structure of a driving system (power transmission system) of the automatic document feeding apparatus.
Figure 3:
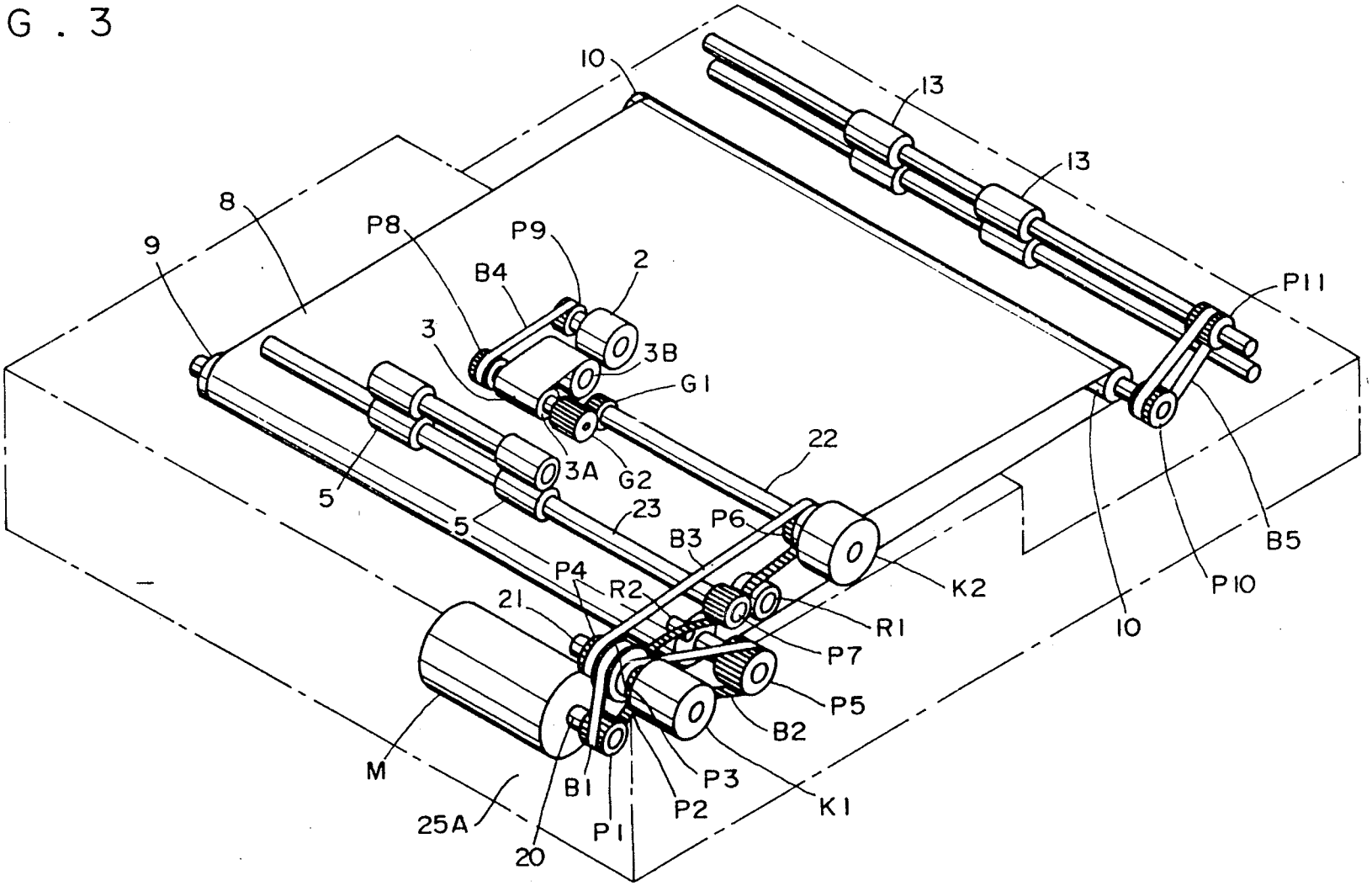
FIG. 3 is a perspective view showing a document feeding system and the driving system installed in the apparatus mentioned above.
Figure 4:
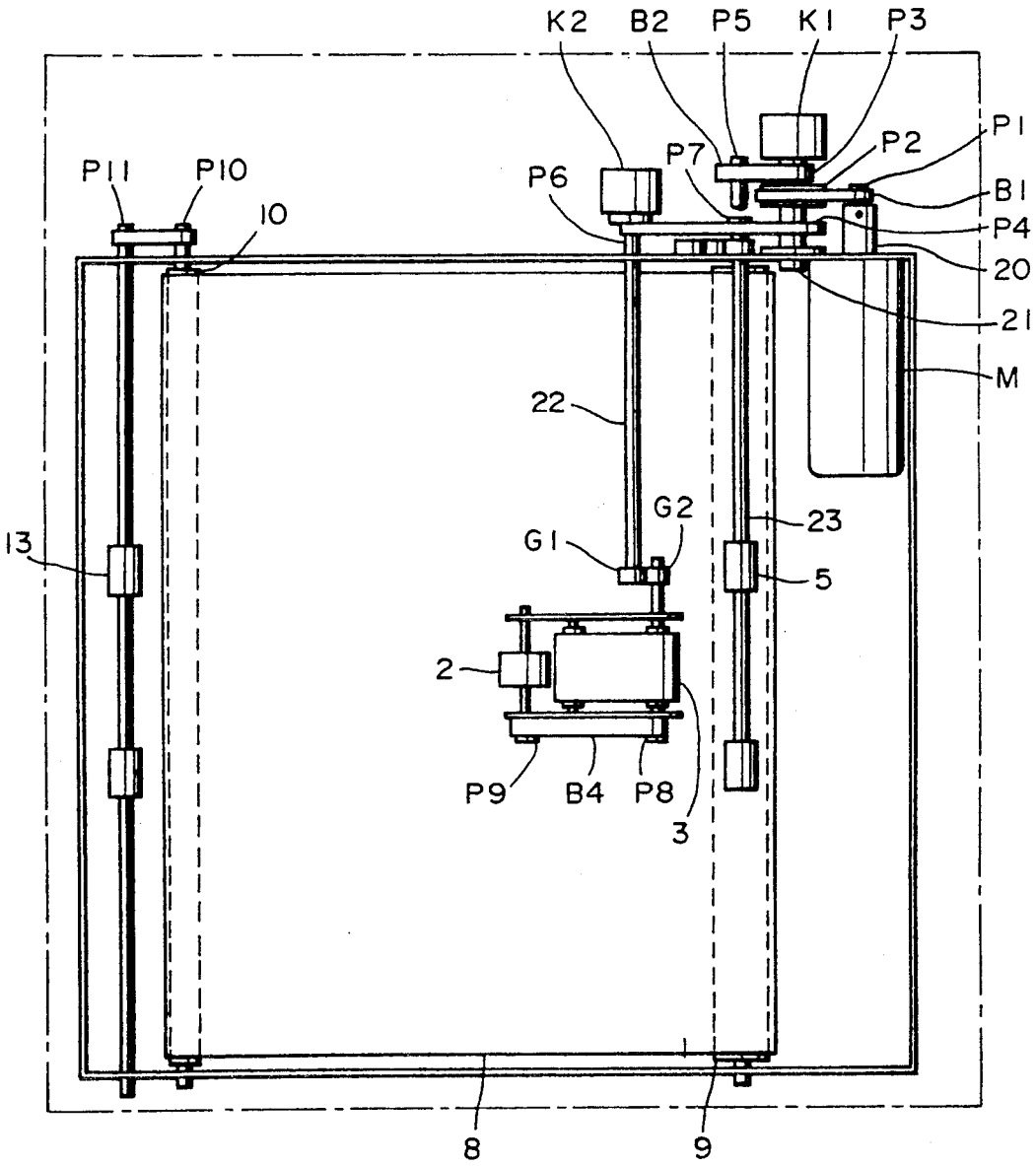
FIG. 4 is a plan view showing essential part of the automatic document feeding apparatus.

Subsequently, with reference to FIGS. 2, 3, and 4, a driving system for the rollers and belts mentioned above will be described.

The driving motor M is a servomotor comprising a DC motor and a speed controller (such as an encoder and tachogenerator) as an integrated body. A timing belt B1 is trained around a timing belt pulley Pl integrated with a driving shaft 20 of said servomotor M and a timing belt pulley P2 fixed to an intermediate shaft 21 to be rotated by the motor M.

On the intermediate shaft 21 mentioned above, timing belt pulleys P3 and P4, and the magnetic clutch K1 are mounted in addition to the timing belt pulley P2 mentioned above. Around said timing belt pulley P3 and a timing belt pulley P5 fixed to the shaft-end of said carrying belt driving roller 9, a timing belt B2 is wound rotatably.

By the rotation of said carrying belt driving roller 9, the driven roller 10 is rotated through the carrying belt 8, and the delivery roller 13 is rotated by the rotation of a timing belt pulley P10 fixed to the shaft-end of the driven roller 10 which is engaged with a timing belt pulley P11 through a timing belt B5.

A timing belt B3 turning wound around the timing belt pulley P4 mounted on said intermediate shaft 21 is engaged with a timing belt pulley P6 mounted at one end of a feed roller shaft 22 which rotates the feed roller 3A through gears G1 and G2, and with a timing belt pulley P7 mounted at the end of a intermediate roller shaft 23 which is integral with the intermediate carrier roller 5. R1 and R2 are tension rollers which are in pressure contact with the outer circumference of the timing belt B3 mentioned above to tension the belt.

By the rotational movement of the timing belt B3, the feed roller 3A is rotated by the feed roller shaft 22 incorporated with the timing pulley P6 through the gears G1 and G2. Thus, the feed belt 3 trained around the feed roller 3A and a free roller 3B is driven so as to rotate also the pick-up roller 2 by timing belt pulleys P8 and P9 and a timing belt B4. In the meantime, at the other end of the feed roller shaft 22, the magnetic clutch K2 is mounted to control the feed belt 3 and the pick-up roller 2 mentioned above in accordance with inputted signals for feeding documents.

When both sides of a document are to be copied, the document whose first face has been exposed for copying by said process is carried on the document glass plate 101 to the right by the carrying belt 8 because the carrying belt driving roller 9 is started to rotate counterclockwise in synchronization with the completion of the exposure operation. The right hand end portion of the document thus carried is brought to said document reversing section 30. Hence, the document D is nipped and fed by carrying rollers 31, 32, and 33 sequentially along the guide plate 34 in the document reversing section 30. Then, the leading edge of the document D is carried onto the document glass plate 101. Before this feeding, the leading edge of the document causes the document synchronization sensor PS5 (sensor for detecting the passing of the reversed document) to give a signal for switching said carrying belt driving roller 9 to rotate clockwise again.

Figure 8:
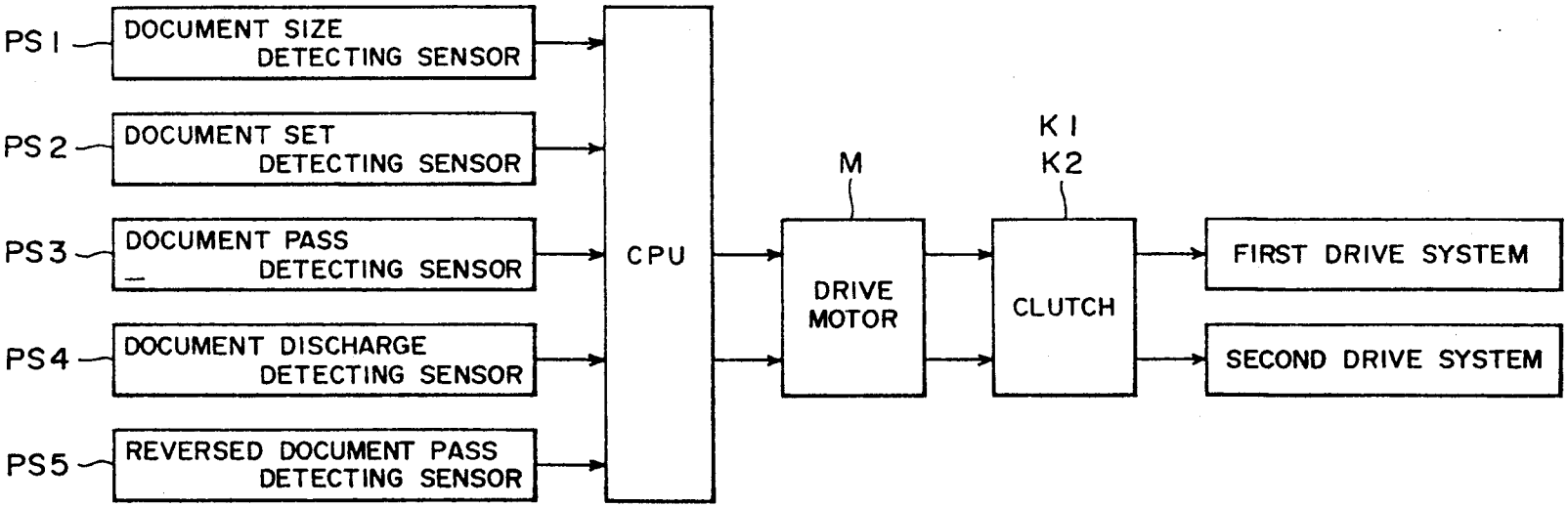
FIG. 8 is a block diagram showing said driving system.
Figure 9A:
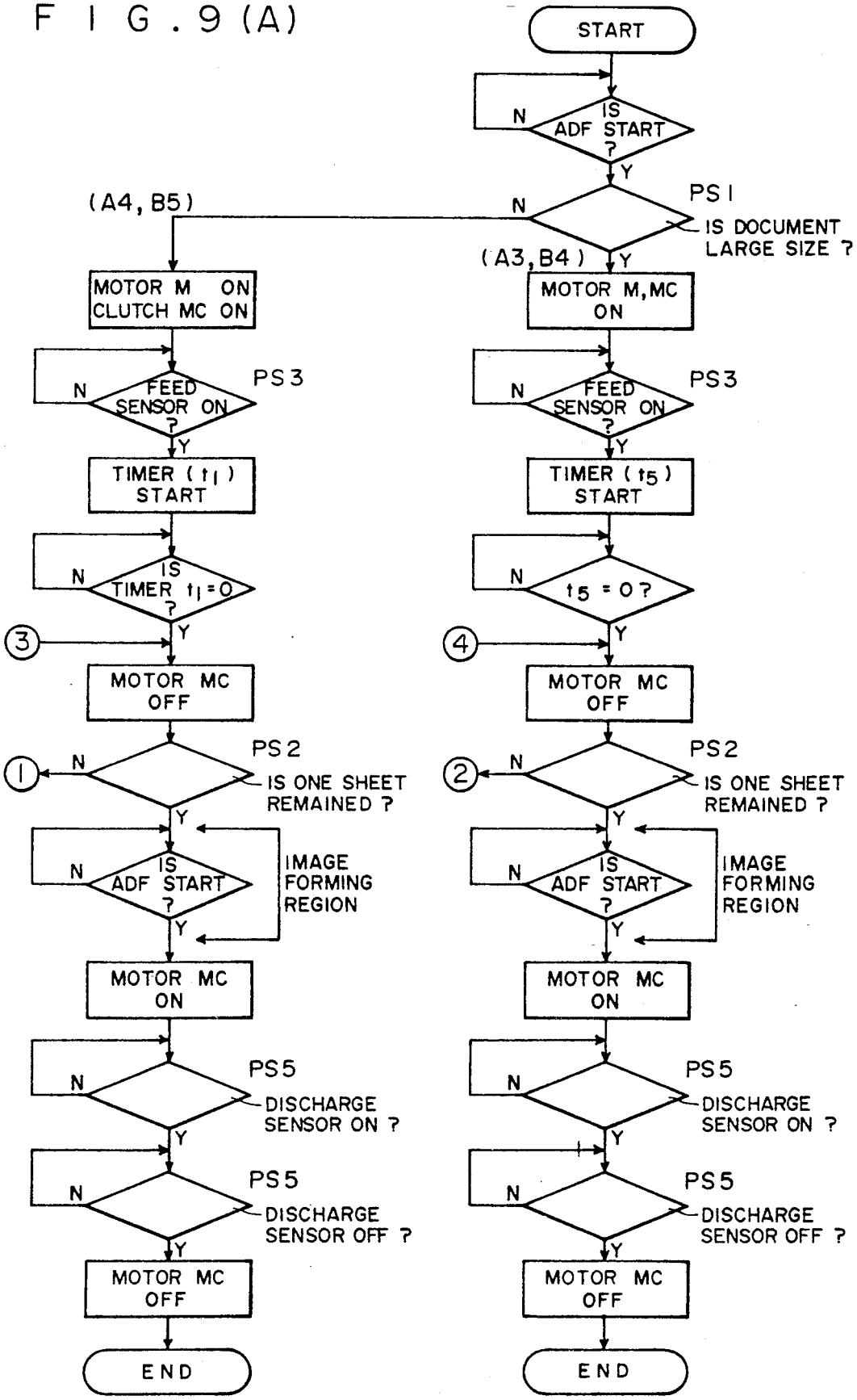
FIGS. 9(A) and 9(B) are flowcharts showing the process of document feeding and carrying.
Figure 9B:
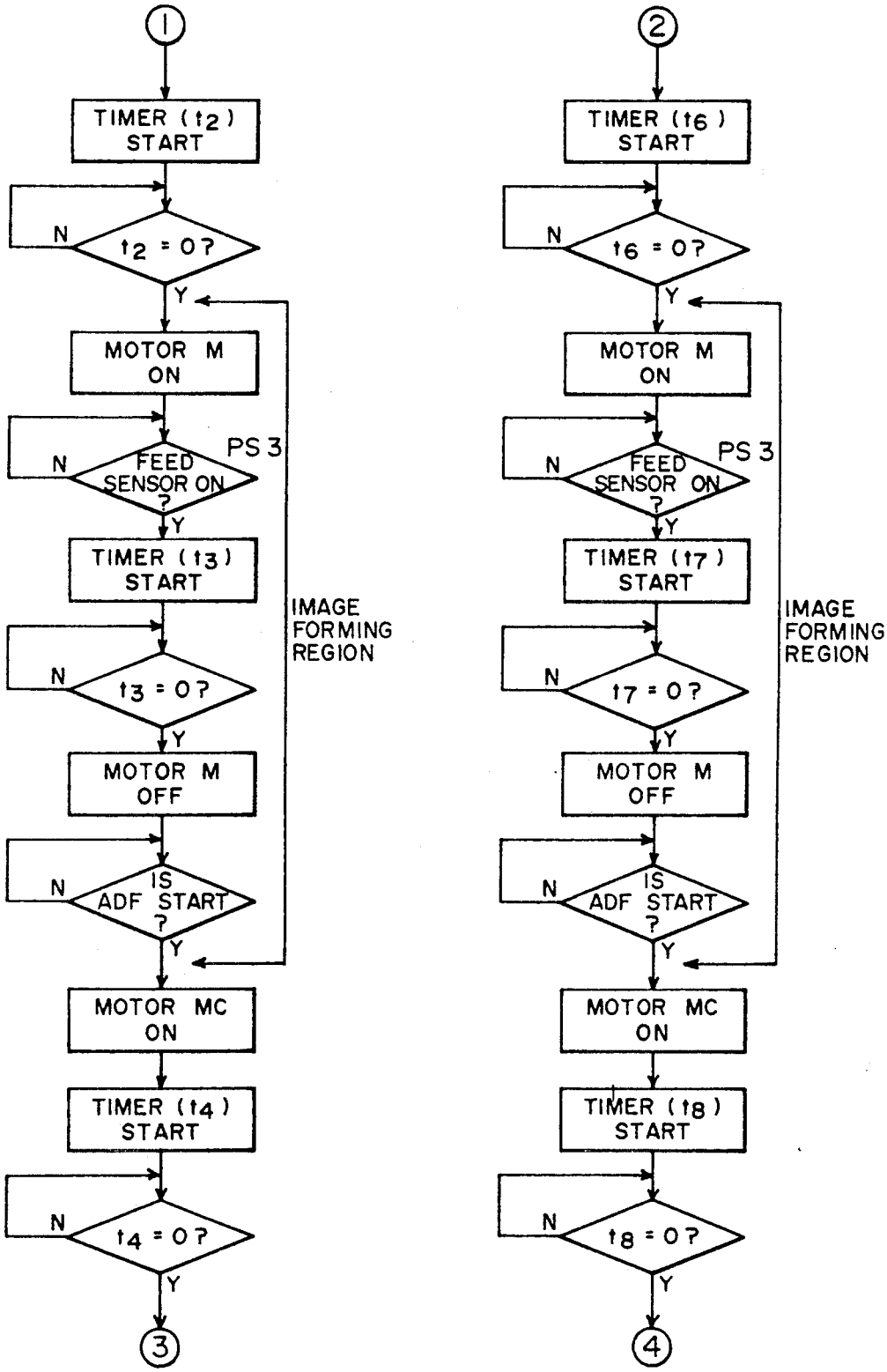
Figure 10:
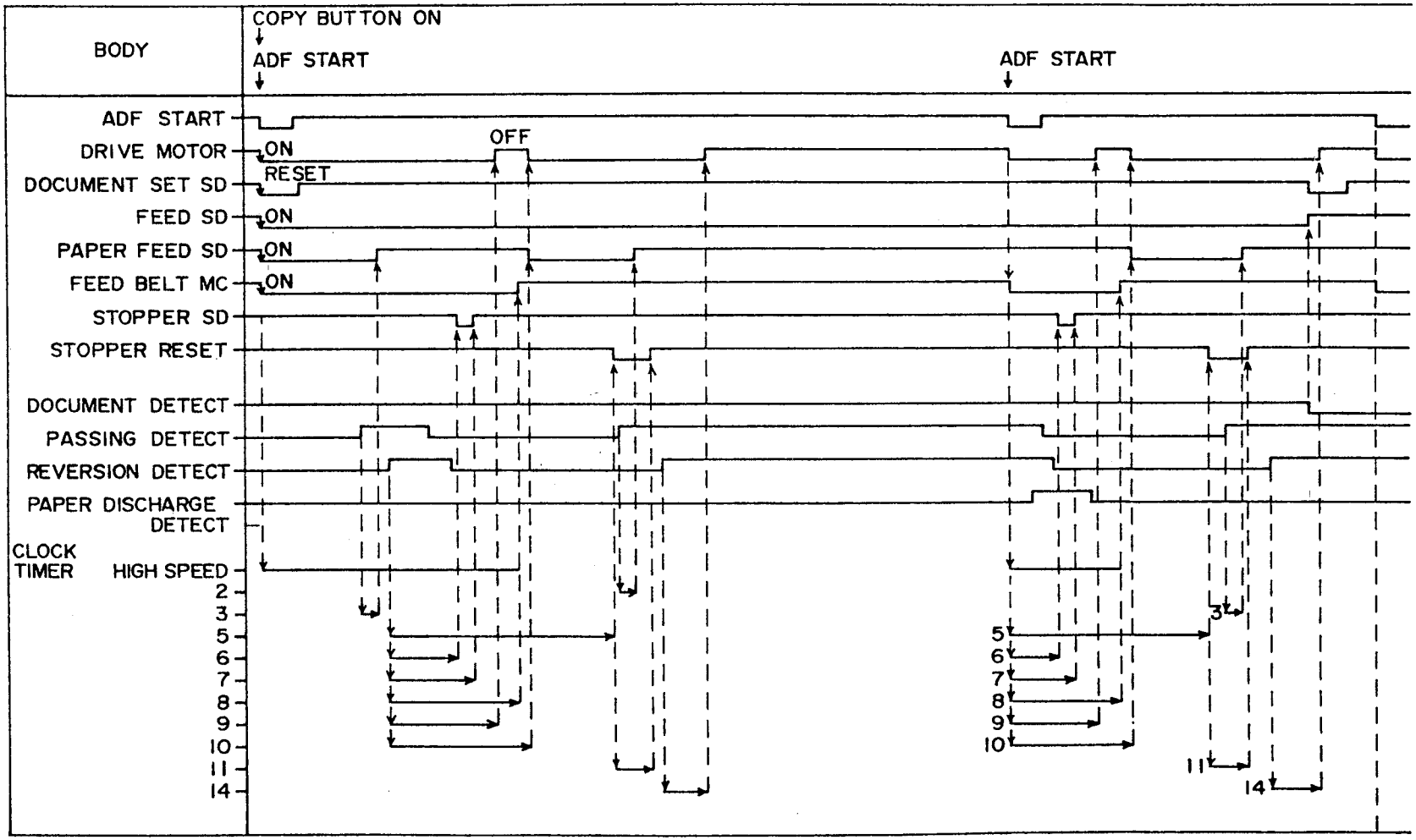
FIG. 10 is a timing chart of the processes of document feeding and carrying.

These have been the brief structure of the driving system for transmitting the driving power of the servomotor M. Subsequently, the movement of said driving system will be described. FIGS. 6(A),6(B) and 6(C) are schematic views illustrating the type of processes of feeding and carrying documents, FIG. 7 is a table showing the rotational speeds of each feed roller driven by the driving system, FIG. 8 is a block diagram showing said driving system, FIGS. 9(A) and 9(B) are flowcharts, and FIG. 10 is a timing chart.

(1) When a stack of documents is placed on the document stacker 1 and abuts against the stopper 1D, the document setting detection sensor PS2 detects the presence of the documents to set up the ADF mode.

(2) Breadth regulating boards 1A and 1A are adjustably moved to come into contact with the side edges of the stack of documents. Then, the width thereof is detected by the document size detecting sensor PS1, and the CPU determines the length of document for storage.

(3) Depressing the copy button 111 allows a copy start signal to be inputted, so that the pick-up roller 2 is lowered to press the top sheet of the stack of documents.

(4) Subsequently, the motor M is started to drive the timing belt pulley P1 mounted on the driving shaft 20 of the motor. Then, the intermediate shaft 21 with the timing belt pulley P2 is rotated through the timing belt B1. At this time, the magnetic clutches (MC) K1 and K2 are both made in ON condition, and the feed roller shaft 22 is driven to rotate by the rotational movement of the timing belt B3. Then, the feed belt 3 is rotatably moved through the gears G1 and G2, and the feed roller 3A. The pick-up roller 2 is also rotated by the timing belt B4. At the same time, the timing belt pulley P7 engaged with the timing belt B3 mentioned above is also rotated to cause the intermediate carrying roller shaft 23 to be rotated. Hence, the intermediate carrying roller 5 is in a rotational condition.

Also, simultaneously with this movement, the timing belt B2 trained around said timing belt pulleys P3 and P5 causes the carrying belt driving roller 9 with the timing belt pulley P5 to rotate. Thus, the carrying belt 8 trained around said roller 9 and driven roller 10 is moved. Also, at this time, the peripheral speed of each of the pick-up roller 2, feed belt 3, intermediate carrying roller 5, and carrying belt 8 is all in a high-speed feeding mode $V_1$ (for example, the peripheral speed $V_1=1{,}200$ mm/sec).

By the rotation of each roller and the rotational movement of each belt mentioned above, the top document of the stack of documents placed on the document stacker 1 is fed by the pick-up roller 2, and is handled by the feed belt 3 and double-feed preventive roller 4. The top sheet of document is thus carried through the intermediate carrying roller 5 and guide plate 6 and is subsequently caused to slide on the document glass plate 101 under pressure by the carrying belt 8 which is in the state of rotational movement. Then, before the leading edge of the sheet of document reaches the position where it abuts against the document stopper 102, the sheet thereof causes the motor M to be in the OFF condition and a motor brake is applied to the motor so that the document is pressed against the stopper by the inertial force of the carry system. In this respect, the motor is deenergized when the document reaches a position approximately 5 to 10 mm before the stopper in this embodiment.

(5) When the document is at rest in this image exposure section, a scanning exposure is started by an optical system equipped in the body of the reproducing machine. Then, before the scanning exposure is started or while the scanning exposure is being conducted, the next document is fed out and carried through the feed belt 3 and intermediate carry roller 5, and when the leading edge of the document passes the document pass detecting sensor PS3, a detection signal is outputted. Then, at a time t of a timer (or by pulse-counting by a counter), the document is stopped at a given position for stand-by. During this period, since the feeding magnetic clutch K2 is turned on while the carry magnetic clutch K1 is turned off, the foregoing document is at rest under the exposure for copying whereas the following document is being fed and carried in a low-speed mode $V_2$, and its leading edge reaches the vicinity of the document glass plate 101 for stand-by. However, for the movement during this period, the speed $V_2$ (for example, $V_2=500$ mm/sec) is defined so as to complete this movement before the start signal is generated for restarting at least after the termination of scanning.

Figure 11:
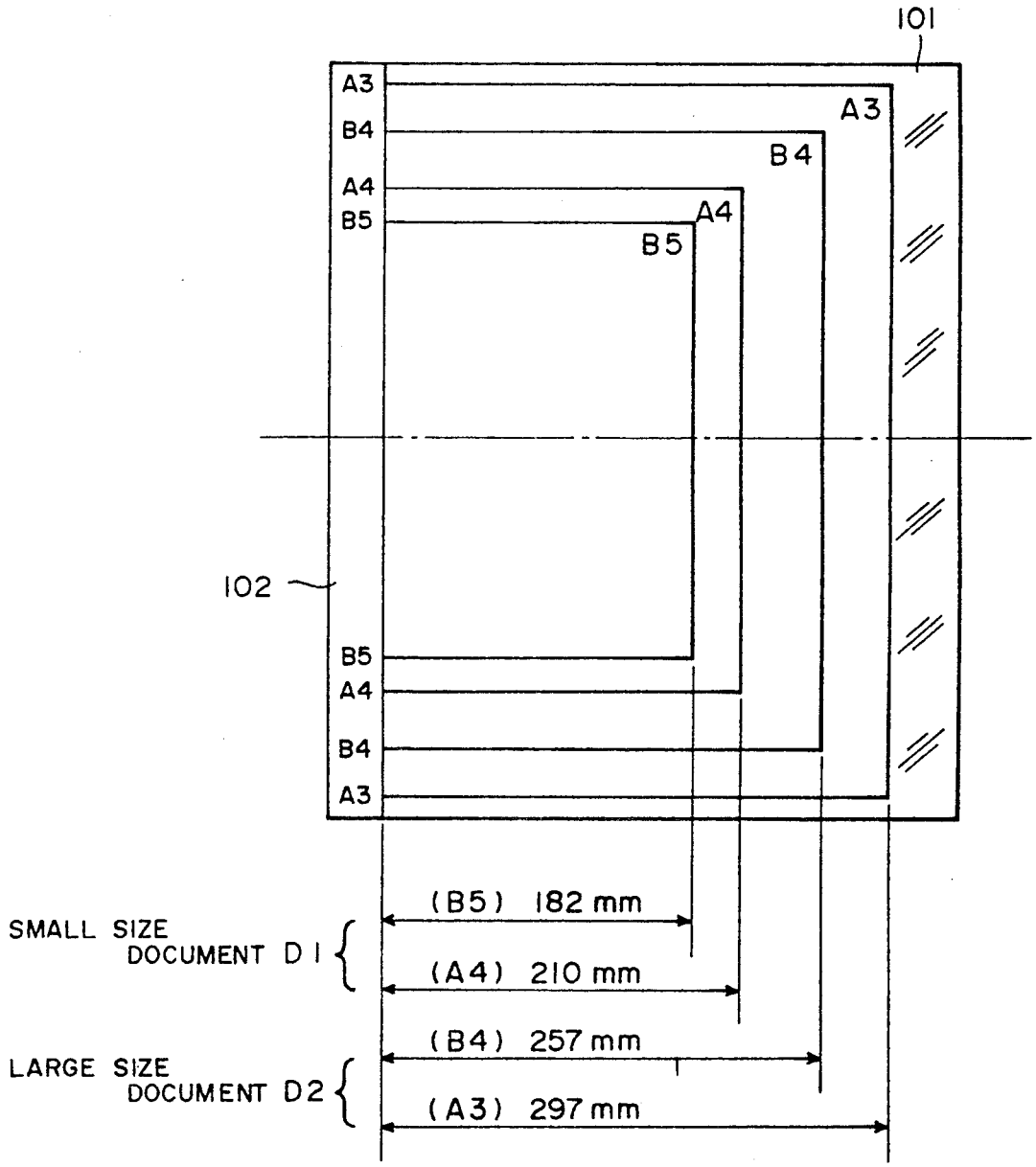
FIG. 11 is a plan view showing the positions for sizes of documents.

The stand-by positions of the following document mentioned above are provided for the different sizes of each different document, i.e., the position differs in accordance with the length of the document in the carrying direction. FIG. 11 is a plan view showing the documents of different sizes (B5~A3) at rest on the document glass plate 101 when the respective documents abut against the document stopper 102.

The above four kinds of document sizes are briefly divided into two kinds according to an embodiment of the present invention, i.e., for example, B5 and A4 are defined as small sizes and B4 and A3, as large sizes.

Figure 6:
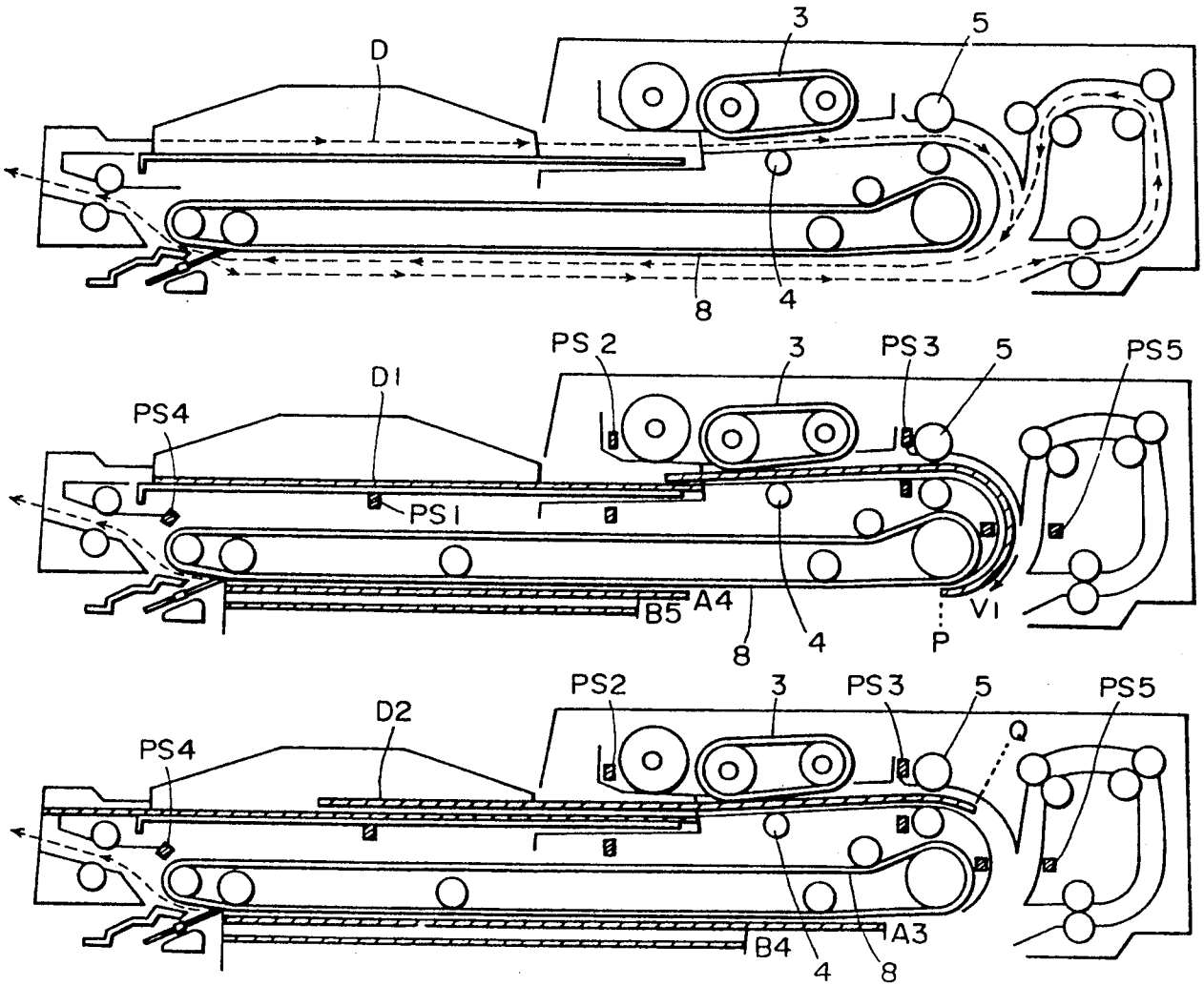
FIGS. 6(A), 6(B), and 6(C) are schematic views illustrating the process of feeding and carrying documents.

FIG. 6(B) is a view showing a process of feeding and carrying the above-mentioned small size documents D1 (B5 and A4). When the document size is detected by the document size detecting sensor PSI in accordance with the movement of said breadth regulating boards 1A and 1A, the document is judged to be of a small size D1 by processing this detection signal.

A timer t3 is started when the leading edge of the following small size document D1 passes through the document pass detecting sensor PS3, and the motor M is suspended when a given timing for the small size document D1 passes. Then, the top of the document D1 is stopped at the position designated by character "P" shown in FIG. 6(B). The speed of carrying document $V_2$ until the time t3 is slower than the speed of carrying document $V_1$ on the document glass plate 101 (for example, $V_1=1{,}200$ mm/sec, $V_2=500$ mm/sec). Furthermore, the leading edge of the document D1 at the position P for the temporary stop mentioned above is in a place where it is not pressed against the carrying belt 8 but still in the vicinity of the document glass plate 101. Therefore, the leading edge of this document is close to the trailing end of the foregoing document.

(6) Subsequently, at the end of scanning exposure, the main motor is turned on, and the carry magnetic clutch K1 is also energized. Thus, the foregoing document is carried by the carrying belt 8, and delivered and placed on the delivery tray 14 through the delivery roller 13. Also, at the same time, the following document is nipped and carried slidingly from the stand-by position onto the document glass plate 101, and when the leading edge thereof abuts against the document stopper 102 under said stopping manner, the replacement of the documents is completed. At this time, the document carry is in a high-speed mode $V_1$ until a timer t4 is completed.

(7) A feed and carry processes of said large size documents D2 (B4 and A3) is shown in FIG. 6(C). When the leading edge of the following document D2 passes the document pass detecting sensor PS3, a timer t7 is started, and when a given timing for large size document D2 elapses, the motor M is suspended so as to stop the leading edge of the document D2 at the position designated character "Q" in FIG. 6(C). The document carrying speed until the time t7 is $V_1$. Also, since the time t7 mentioned above is set shorter than the time t3 for said small size document D1, the document stop position Q is in a place near the intermediate carrying roller 5. There is held a fixed distance between the leading edge of this following document D2 at the stop position and the trailing edge of the foregoing document abutting against the document stopper 102 on the document glass plate 101.

By an automatic document feeding apparatus according to the prevent invention, the leading edge of a following document is temporarily brought to a place close to the trailing end of a foregoing document to maintain the minimum distance therebetween, irrespective of the sizes of documents. Therefore, when the foregoing document is delivered to the document tray, the following document is simultaneously restarted to move from the temporary stop position either P or Q. Hence, its carry distance of the document is short, so that the required time for replacing documents is also short. As a result, the speed of continuous copying operation (the number of copies per minute) can be improved.

Also, the document carrying speed $V_2$ of a following document in a preceding advance distance can be set independent of the carry speed $V_1$ of the foregoing document. Thus, setting the $V_2$ at a low speed allows the document separation by the feed belt 3 and double-feed preventive roller 4 to be conducted at a low speed so as to improve the document separation performance. Also, a low-speed carry of documents improves the accuracy of the stop positions.

The same effect is obviously obtainable for the first sheet of the documents if it is fed at a low speed $V_2$ to the position of the sensor PS3 and is subsequently carried at a speed $V_1$.

Also, the restart of carrying a document from the stop position at the document stopper 102 for the delivery is not made at the same time of restarting the double-feed preventive processing in a document feeding. Hence, the load applied to the motor can be reduced so as to curtail the required power consumption as well as to make it possible to employ a low torque motor.

Furthermore, the low-speed document feeding allows the document nipping by the intermediate carrying roller 5 and the subsequent U-turn of the document through the guide plate 6 to be conducted smoothly with the result that damages to the tip of documents are minimized.

In this respect, although the above-mentioned two driving systems are controlled and operated by a motor and two magnetic clutches according to this embodiment, the same control and operation can be carried out by two motors and a magnetic clutch.

Also, in the case where a document is carried backward into the document reversing section 30 and is again carried onto the document glass plate after it has been reversed for copying both sides of the document, the same effect can be obtained if temporary stop positions are set respectively for large size documents and small size documents as previously described with the clock timing started when the passing of the document is detected by the reversed document passing detection sensor PS5.

With the automatic document feeding apparatus according to the embodiment set forth above, it is possible not only to shorten the time required for document feeding, but also to improve the reliability of separation performance and to effectively conduct the smooth feeding as well as the prevention of any possible damages to the leading edge of documents by feeding documents at a low speed. Also, it is possible to reduce the load on the motor, curtail the power consumption, and employ a small, low-torque motor.

Figure 12:
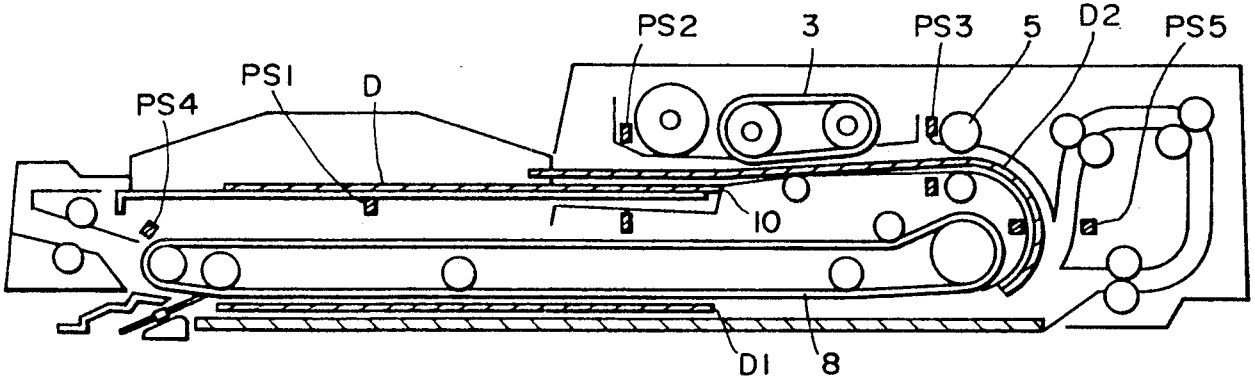
FIGS. 12(A) and 12(B) are schematic views illustrating the process of feeding and carrying documents according to another embodiment of the present invention.
Figure 12:
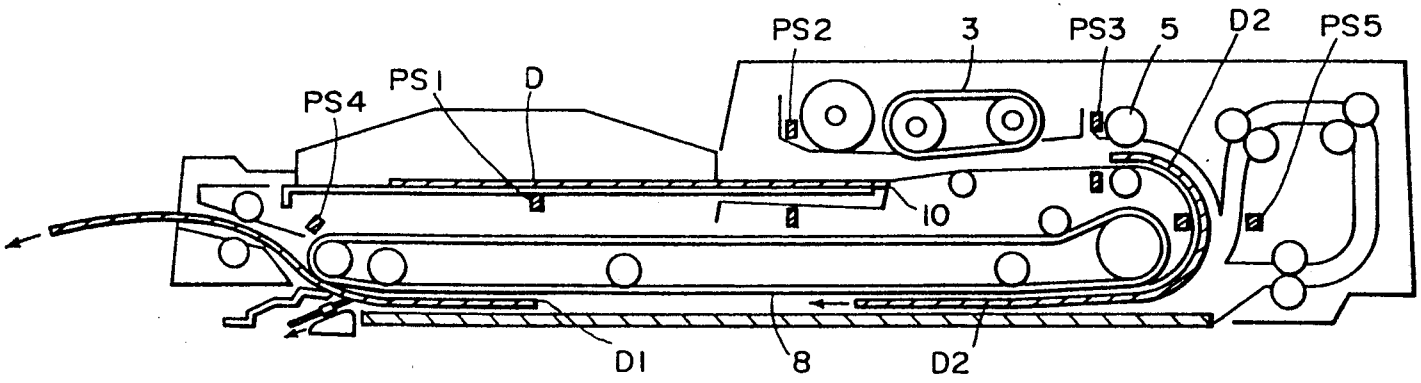
Figure 13:
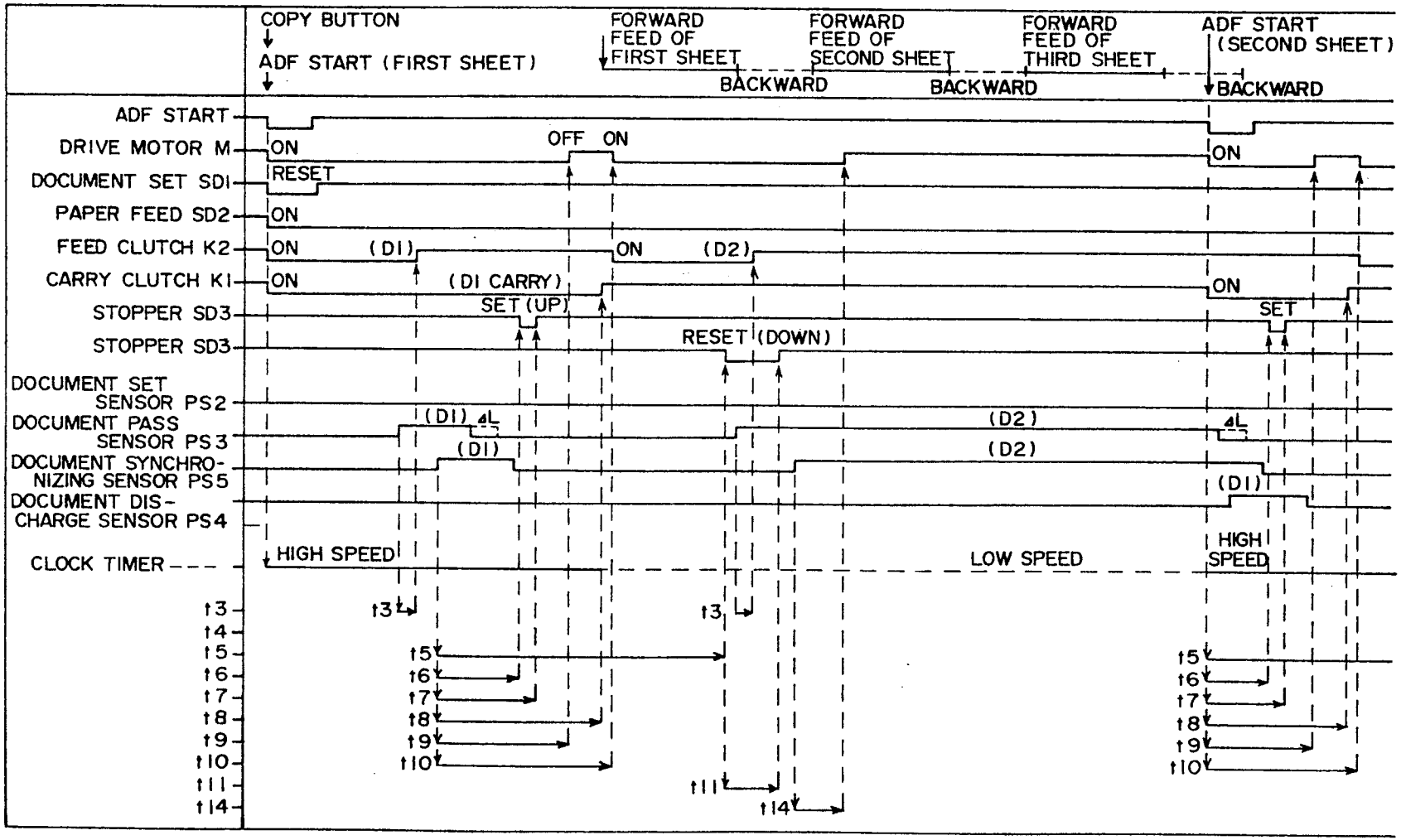
FIGS. 13(A) and 13(B) are timing charts of the process of document feeding and carrying.
Figure 13:
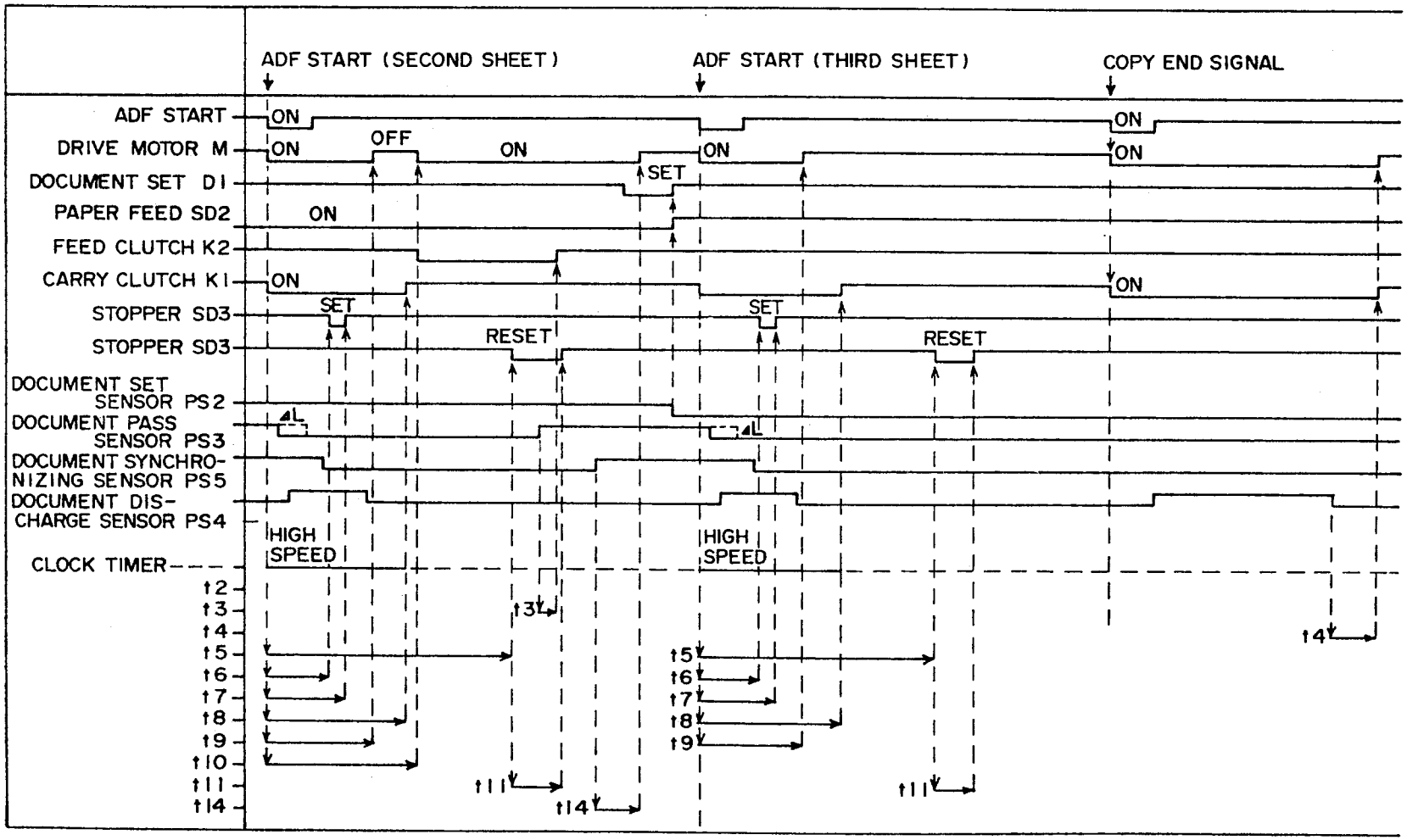

Subsequently, another embodiment according to the present invention will be described. FIGS. 12(A) and 12(B) are schematic views illustrating a process of feeding and carrying documents, and FIGS. 13(A) and 13(B) are time charts. All the controls of (1) When a stack of documents is placed on the document stacker 1 and abuts against a document edge stopper 1D which is at rest at the projected position, the document setting detection sensor PS2 detects the presence thereof to set the ADF mode.

(2) Breadth regulating boards 1A and 1A are adjustably moved to come into contact with the said edges of documents. Then, the width thereof is detected by the document size detecting sensor PS1, and the CPU is caused to calculate and store the length thereof.

(3) Depressing the copy button 111 allows a starting signal for copying to be inputted so as to start the reproducing machine 100 and the automatic document feeding apparatus.

(4) With this ADF start signal, a voltage is applied to the document setting solenoid SD1 in order to lower the projected end of the document edge stopper 1D. At the same time, a voltage is applied to the document feed solenoid SD2, so that the pick-up roller 2 is lowered to press the top sheet of the stack of documents.

(5) Also, at the time of the start of the driving motor M, the timing belt pulley P1 mounted on the motor driving shaft 20 is simultaneously rotated. Thus, the intermediate shaft 21 with the timing belt pulley P2 is rotated through the timing belt B1. At this time, both magnetic clutches K1 and K2 are in ON conditions so as to rotate the feed roller shaft 22 by the rotational movement of the timing belt B3, and to cause the feed belt 3 to be rotatably moved through the gears G1 and G2 as well as the feed roller 3A. The pick-up roller 2 is also rotated by the timing belt B4. At the time of the rotation of the timing belt pulley P7 meshing with the timing belt B3 mentioned above, the intermediate carrier roller shaft 23 is simultaneously rotated to allow the intermediate carrier roller 5 to be in a rotational condition.

Also, at the same time, the carrier belt driving roller 9 with the timing belt pulley P5 is rotated by the timing belt B2 which is trained around said belt pulleys P3 and P5. Hence, the carrying belt 8 trained around said roller 9 and the free roller 10 is rotatably moved. In this respect, the peripheral speed of each of the pick-up roller 2, feed belt 3, intermediate carrying roller 5, and carrying belt 8 is a high-speed feeding mode $V_1$ (for example, the peripheral speed $V_1 = 1{,}200$ mm/sec).

By the rotation of each roller mentioned above and the rotational movement of each belt mentioned above, a document D1 on the top of the stack of documents placed on the document stacker 1 is fed out by the pick-up roller 2, and is handled by the feed belt 3 and the double-feed preventive roller 4. Thus, the first sheet of the top of the documents D1 is separated and fed.

(6) When the leading edge of the document D1 separated and fed as mentioned above is passed through the document pass detecting sensor PS3, a signal is generated to indicate it accordingly. Then, with this signal, the clock timer is started. At a time t3, the document feed clutch K2 is disengaged. Hence, the leading edge of the document D1 is passed through a nipping position of the intermediate carrying roller 5. Then, the rotational driving of the pick-up roller 2 and the feed belt 3 are stopped. Thereafter, they are driven freely.

(7) The intermediate carrying roller 5 is continuously driven to rotate so as to carry the document D1 through the document synchronization sensor PS5 onto the document glass plate 101. Then, the document is slidingly carried thereon under pressure by the carrying belt 8 which is being moved.

(8) At a time t6 since the passing of the document through the synchronization sensor PS5 mentioned above, the document stopper solenoid SD3 is actuated to cause the document stopper 102 to be projected above the left upper face of the document glass plate 101. This solenoid SD3 is of latch type, so that unless it is reset, it remains in a state of attraction.

(9) At this time, before the leading edge of the document reaches the document stopper 102, i.e., at a time t9 after the document passes through the synchronous sensor PS5 mentioned above, the driving motor M is suspended and a brake is applied to stop the rotation of the motor. However, because of the inertial force, each driving member is allowed to move continously for a while. Thus, the document is still carried. This motor brake may effectively be applicable by short-circuiting both terminals of motor M or by some other methods such as to apply a reverse voltage.

Thereafter, the carry clutch K1 is disengaged at a time approximately t8 to control the carrying belt 8 so as to cause the carrying belt 8 to stop. Here, although the carrying belt 8 decelerates, it proceeds by the inertial force of the carry system. However, since there is the document stopper 102, the document is not carried any more when it abuts against the document stopper 102.

Also, almost at the time t8, the clock is switched from a high-speed to a low-speed.

At a time t10, the feed clutch K2 is engaged, and the driving motor M is started. Hence, the next document D2 is fed by the pick-up roller 2 and feed belt 3.

When the document is at rest in the image exposure section, the scanning exposure is started by the optical system 103 equipped in the body of the reproducing machine 100. At this time, before the scanning exposure begins or during the period of the scanning exposure, the next document D2 is fed out and carried through the feed belt 3 and the intermediate carrying roller 5. When the leading edge of the following document D2 is passed through the document pass detecting sensor PS3, a detection signal is given to cause this document D2 to stop at a given position for stand-by with a timing t of the clock timer (or by the pulse-counting of a counter). During this period, the feed magnetic clutch K2 is disengaged to effectuate the double-feed prevention of the following documents as soon as the document is nipped by the intermediate carrying roller 5. Although the carry magnetic clutch K1 is in the OFF condition to allow the foregoing document D1 to be at rest in the exposure section, the leading edge of the following document D2 is fed to the location in the vicinity of the document glass plate 101 in a low-speed mode $V_2$ during this period, and is in stand-by condition. However, the speed of the movement during this period is set at $V_2$ (for example, $V_2=500$ mm/sec) so as to complete the movement before a restart signal is generated, at least after the termination of the scanning.

The stand-by position of the following document mentioned above is defined for each different size document, i.e., it is set up variably according to the length of a document in the feeding direction.

FIG. 12(A) is a view showing the process of feeding and carrying the foregoing document D1 and the following document D2 mentioned above.

When the leading edge of the following document D2 is passed through the document pass detecting sensor PS3, the clock timer is started, and at a time t2, the feed clutch K2 is disengaged to cause the document feeding to stop. Subsequently, when the leading edge of the document D2 is passed through the document synchronization sensor PS5, the driving of the driving motor M is stopped at a time t14 by the clock timer. In this respect, since the leading edge of the document D2 at the temporary stop position P mentioned above is in the vicinity of the document glass plate 101 where it is not pressed against the carrying belt 8, it is close to the trailing end of the foregoing document.

Subsequently, at the time of scanning exposure, the ADF starting signal is generated by the reproducing machine 100 in order to perform the exposure process for the second sheet of the documents. In other words, the driving motor M is energized and the carrier magnetic clutch K1 is engaged. Hence, the foregoing document D1 is carried by the carrying belt 8, and delivered onto the document tray 14 through the delivery roller 13. Also, simultaneously, the following document D2 is held to slide on the document glass plate 101 from its stand-by position, and to reach the document stopper 102 under said stopping motion. Then, the replacement of the documents is completed. At this time, the speed of carrying documents is in a high-speed mode $V_1$ at the time t8 of the clock timer.

By the ADF starting signal mentioned above, the clock timers t5, t6, t7, t8, t9, t10, and t11 are actuated simultaneously. The clock timers t6 and t7 cause the document stopper solenoid SD3 to be set, and the clock timers t5 and t11 cause said solenoid SD3 to be resetted. Also, the clock timer t8 sends an OFF signal to the carry clutch K1. Furthermore, the clock timers t9, t10 and t14 control the ON/OFF of the driving motor M.

The document D2 which is the second sheet is carried onto the document glass plate 101 from said temporary stop position P in a high-speed mode $V_1$, and after it is suspended at the time t9, and abuts against the document stopper 102 by the inertial force to stop through said same processes as previously described. Thereafter, as in the case of the foregoing document D1, this document is delivered subsequently to the exposure processing.

Also, in the case where a document is carried backward into the document reversing section 30 and is again carried onto the document glass plate after it has been reversed for copying both sides of the document, the same effect can be obtained if a temporary stop position is similarly set up, with the clock timer started when the passing of the document is detected by the reversed document pass detecting sensor PS5.

Although the above-mentioned driving system is controlled and operated by a motor and two magnetic clutches according to this embodiment, it is possible to execute the same control and operation by two motors and a clutch.

Figure 14:
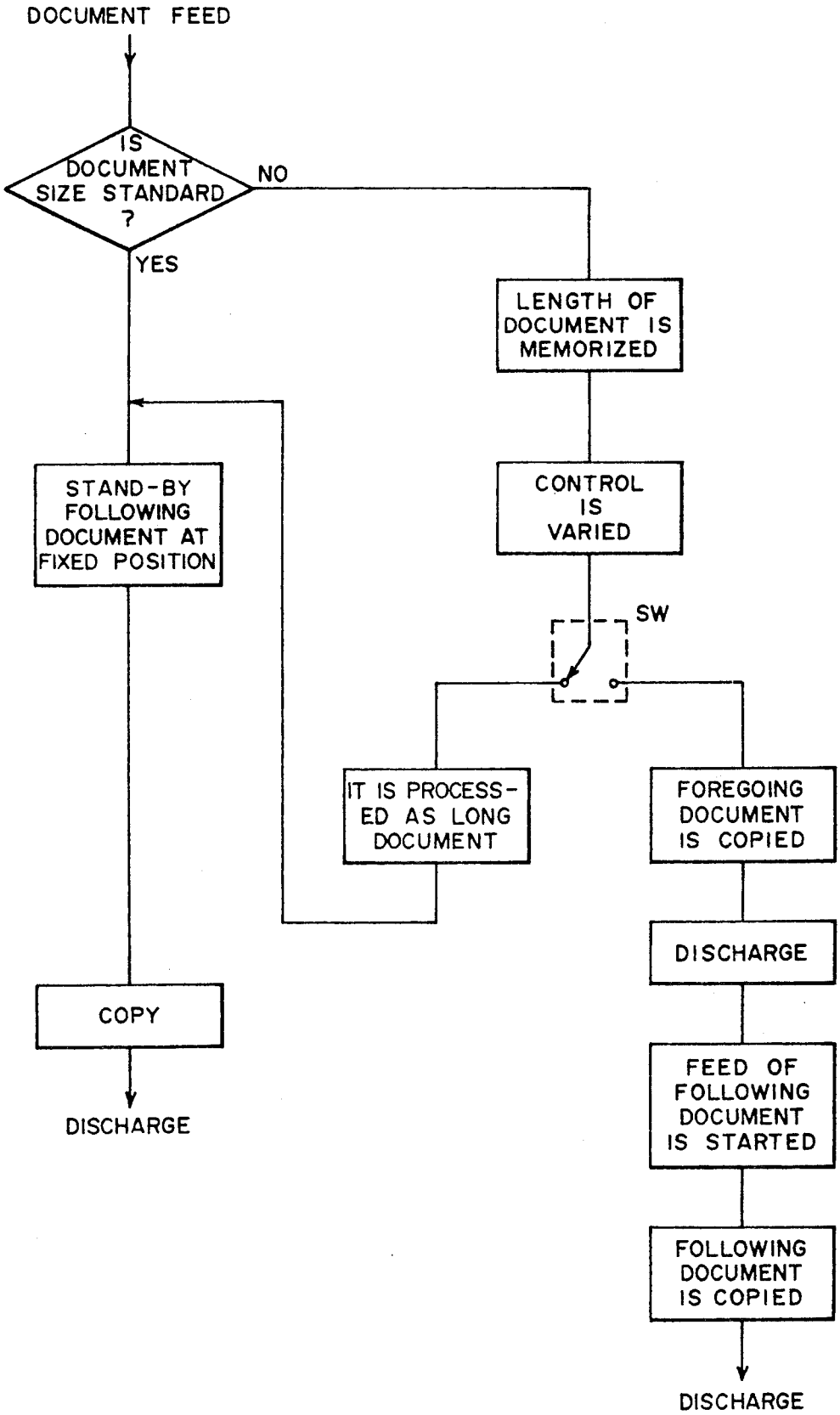
FIG. 14 is a flowchart showing the process of feeding documents of a standard size.

As set forth above, the normal operation for the documents of standard sizes has been described. Subsequently, with reference to FIGS. 13(A) and 13(B) and FIG. 14, the controls applicable to the documents of other sizes than the standard ones will be described.

When the leading end of a document of standard size D (for example, A4 size) reaches the document pass detecting sensor PS3, the document pass detecting sensor PS3 is turned on, and when the trailing end of the document passes the document pass detecting sensor PS3, it is turned off. Thus, the CPU can measure the duration while the document pass detecting sensor PS3 is on and detects the length of the document accordingly. Therefore, by comparing the length of the document thus detected with the length of each standard document calculated in accordance with the width of the document of a standard size detected in advance, the CPU can decide whether or not the length currently detected is the length of a document of a standard size or the length of a document of a size other than those standard ones.

Assuming that a document of a non-standard size Ds, the length of which is different from that of a standard document D by ΔL (longer or shorter by ΔL), is fed and passed through the document pass detecting sensor PS3, the CPU detects that the document pass detecting sensor PS3 is in the ON condition longer (or shorter) than the time while a standard document D is passed. Then, the value of the clock during this document pass detecting sensor PS3 is in the ON condition, i.e., information on the length of the non-standard document Ds is stored in the memory of the CPU, and in order to prepare the processing for the following document which differs from a document of a standard size by ΔL in length, the ADF control is altered to either one of the following two controls.

The first control is that the feeding of the following document of a non-standard size Ds2 is started after the foregoing document has reached the document delivery sensor PS4. In other words, the feeding of the following document of the non-standard size Ds2 after the document delivery sensor PS4 is in the ON condition by the processes of operation described in said (4) and (5), and the following document is not allowed to be in a predetermined stand-by position.

The second control is that among those pieces of information of each length of the documents of standard sizes obtained by the CPU in advance by calculation from each detected width of the documents of standard sized, the CPU uses a length of a standard size longer than that of the document of this non-standard size in order to conduct the required control. In other words, if, for example the width of a document of non-standard size currently fed is of the same width as A4 but is longer than A4 and shorter than B4, this following document of non-standard size Ds2 is controlled as a document of B4 size. These controls are also applicable in the same manner in the case of a document whose width is shorter by ΔL.

This first or second control is selected in advance by a selection switch SW provided on the operation panel.

In this way, even if documents are a mixture of standard and non-standard sizes, the operation of ADF is possible.

With an automatic document feeding apparatus according to the embodiment set forth above, it becomes possible to use the ADF even when there is a mixture of documents of non-standard sizes, unlike the conventional ADF system which is only applicable to documents of standard sizes. It also becomes possible to feed documents at high speeds reliably, so that not only the feeding time for documents is shortened, but also the overall efficiency of copying operations is improved. In addition, since the system controls are mainly executed by a CPU according to the present invention, the controlling programs are so simple and clear that there are less factors of faulty operations. There is also an advantage that the manufacturing cost is reduced.

What is claimed is:

1. An automatic document feeding apparatus for sequentially feeding a plurality of documents to an image exposure section of an electrophotographic recording machine, said apparatus comprising:

a document stacker for holding a stack of documents;

a feed belt for sequentially transporting said documents from said document stacker;

a single carrying belt for carrying said documents from said feed belt through said image exposure section;

a document holding roller for pressing said carrying belt to a platen;

a controller for controlling feeding;

a detector for detecting a size of a fed document;

at least two stop positions upstream of said image exposure section corresponding to different sized documents, an ejector for ejecting said documents after image exposure, said controller controlling feeding whereby, before completion of an exposure of a foregoing document, a following document is fed to one stop position of said at least two stop positions by said feed belt and temporarily stopped thereat, said one stop position being selected in accordance with a document size detecting signal from said detector so that a distance between the trailing end of said foregoing document and the leading end of said following document temporarily stopped at said stop position remains constant irrespective of the size of said document, said following leading end of said document, at said one stop positions being located between feed belt and said document holding roller.

2. The apparatus of claim 1 further comprising a variable speed driver for driving said carrier belt wherein a feeding speed for feeding said following document to said stop positions by said feed belt is lower than a carrying speed for carrying said foregoing document through said image exposure section by said carrying belt.

3. An automatic document feeding apparatus for sequentially feeding a plurality of documents to an image exposure section of an electrophotographic recording machine, said apparatus comprising, a document stacker for holding a stack of documents;

a feed belt for sequentially transporting said documents from said document stacker;

a single carrying belt for carrying said documents through said image exposure section;

a document holding roller for pressing said carrying belt to a platen;

a controller for controlling feeding;

a detector for detecting a size of a fed document;

at least two stop positions upstream of said image exposure section, said at least two stop positions being positioned between said feed belt and said document holding roller upstream of said image exposure section; and an ejector for ejecting documents after image exposure;

said detector being positioned downstream of said document stacker for detecting a tip and trailing end of a passing document and transmitting a detecting signal to said controller, for determining the size of a fed document;

said controller comparing a length of said document detected by said detector to a predetermined document size; whereby, if said document is a non-standard sized document having a length greater or less than said predetermined document size, said control adjusts said stop positions so that the stop position of a document following said non-standard size document is adjusted to account for the length of said non-standard size document.

4. The apparatus of claim 3 further comprising a variable speed driver for driving said carrying belt wherein a feeding speed for feeding a following document to said stop positions is lower than a carrying speed for carrying a foregoing document through said image exposure section.

5. The apparatus of claim 3 further comprising a second detector for detecting said predetermined document size, wherein said second detector is mounted on said document stacker, said stacker being arranged so that a direction normal to a document feeding direction is in a longitudinal direction of the document.

6. The apparatus of claim 3 wherein, when a non-standard sized document is detected, one of said at least two stop positions is selected by said controller in accordance with a detected size of a document, and a following document is not fed until image exposure of a foregoing document is completed.

7. An automatic document feeding apparatus for sequentially feeding a plurality of documents to an image exposure section of an electrophotographic recording machine, said apparatus comprising:

a document stacker for holding a stack of documents;

a double-feed preventive member for sequentially separating said documents one by one from said stack;

a pair of intermediate carrying rollers for transporting said documents from said double fed preventive member;

a single carrying belt for carrying said documents from said intermediate carrying rollers through said image exposure section;

a document holding roller for pressing said carrying belt to a platen;

a controller for controlling feeding;

a detector for detecting a size of a fed document;

at least two stop positions upstream of said image exposure section;

an ejector for ejecting said documents after image exposure, said controller controlling feeding whereby, before completion of an exposure of a foregoing document, a following document is fed to one stop position of said at least two stop positions and temporarily stopped thereat, said one stop position being selected in accordance with a document size detecting signal from said detector so that a distance between the trailing end of the foregoing document and the leading end of a following document temporarily stopped at said stop position remains constant irrespective of the size of said document, said leading end of said following document at said one stop position being located between said intermediate carrying rollers and said document holding roller.

8. The apparatus of claim 7 further comprising a variable speed driver for driving said carrying belt wherein a feeding speed for feeding said following document to said stop positions by said intermediate carrying rollers is lower than a carrying speed for carrying said foregoing document through said image exposure section by said carrying belt.

9. An automatic document feeding apparatus for sequentially feeding a plurality of documents to an image exposure section of an electrophotographic recording machine, said apparatus comprising, a document stacker for holding a stack of documents;

a double feed preventive member for sequentially separating said documents from said stack, a pair of intermediate carrying rollers for transporting said documents from said double feed preventive member, a single carrying belt for carrying said documents from said intermediate carrying rollers through said image exposure section, a document holding roller for pressing said carrying belt to a platen, a controller for controlling feeding, a detector for detecting a size of a fed document, at least two stop positions upstream of said image exposure section, said at least two stop positions being positioned between said intermediate carrying rollers and said document holding roller upstream of said image exposure section, and an ejector for ejecting documents after image exposure, said detector being positioned downstream of said document stacker for detecting leading and trailing ends of a passing document and transmitting a detecting signal to said controller, for determining the size of a fed document, said controller comparing a length of document detected by said detector to a predetermined document size, whereby, if said document is a non-standard size document having a length greater or less than said predetermined document size, said control adjusts said stop positions so that the stop position of a document following said non-standard size document is adjusted to account for the length of said non-standard size documents.

10. The apparatus of claim 9 further comprising a second detector for detecting said predetermined document size wherein said second detector is mounted on said document stacker, said stacker being arranged whereby a direction normal to a document feeding direction is the longitudinal direction of the document.

11. The apparatus of claim 9 further comprising a variable speed driver for driving said carrying belt wherein a feeding speed for feeding a following document to said stop position is lower than the carrying speed for carrying a foregoing document through said image exposure section.

12. The apparatus of claim 9 wherein, when a non-standard sized document is detected, one of said at least two stop positions is selected by said controller based on the size of a document, and a following document is not fed until image exposure of a foregoing document is completed.

* * * * *

UNITED STATES PATENT AND TRADEMARK OFFICE

CERTIFICATE OF CORRECTION

PATENT NO. : 5,197,723

DATED : March 30, 1993

INVENTOR(S) : Yamada, et al

It is certified that error appears in the above-identified patent and that said Letters Patent is hereby corrected as shown below:

Title page, Item [30] line 2 change "1-197622"

to --1-197662--.

Signed and Sealed this

Twenty-eighth Day of December, 1993

*Attest:*

Bruce Lehman

BRUCE LEHMAN

*Attesting Officer*

*Commissioner of Patents and Trademarks*